US006341852B1

(12) United States Patent
Yamamoto

(10) Patent No.: US 6,341,852 B1
(45) Date of Patent: Jan. 29, 2002

(54) METHOD AND APPARATUS FOR FORMING IMAGE WITH FEEDBACK CONTROL OF RECORDING LIQUID

(75) Inventor: Ryoichi Yamamoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/665,127

(22) Filed: Sep. 20, 2000

(30) Foreign Application Priority Data

Sep. 20, 1999 (JP) ..... 11-265467

(51) Int. Cl.[7] ..... B41J 2/175
(52) U.S. Cl. ..... 347/85; 347/15
(58) Field of Search ..... 347/85, 14, 15, 347/19, 20

(56) References Cited

U.S. PATENT DOCUMENTS

| | | | | |
|---|---|---|---|---|
| 4,109,282 A | | 8/1978 | Robertson et al. | 358/127 |
| 4,614,953 A | | 9/1986 | Lapeyre et al. | 347/45 |
| 5,371,529 A | | 12/1994 | Eguchi et al. | 347/7 |
| 5,841,448 A | | 11/1998 | Moriyama et al. | 347/19 |
| 5,880,752 A | * | 3/1999 | Weber et al. | 347/15 |
| 6,036,295 A | * | 3/2000 | Ando et al. | 347/7 |
| 6,183,071 B1 | * | 2/2001 | Sugimoto et al. | 347/85 |

FOREIGN PATENT DOCUMENTS

| | | | |
|---|---|---|---|
| JP | 3-207664 | 9/1991 | B41J/2/21 |
| JP | 5-201024 | 8/1993 | B41J/2/175 |
| JP | 7-125259 | 5/1995 | B41J/2/205 |
| JP | 7-232440 | 9/1995 | B41J/2/175 |
| JP | 9-156131 | 6/1997 | B41J/2/21 |

OTHER PUBLICATIONS

Patent Abstracts of Japan 05201024 Aug. 10, 1993.
English Language Abstract JP7125259 May 16, 1995.
English Language Abstract JP3207664 Sep. 10, 1991.
English Language Abstract JP9156131 Jun. 17, 1997.
English Language Abstract EP0661162 Jul. 5, 1995.

* cited by examiner

*Primary Examiner*—N. Le
*Assistant Examiner*—Michael Nghiem
(74) *Attorney, Agent, or Firm*—Sughure Mion, PLLC

(57) ABSTRACT

There is disclosed an image forming method for mixing a plurality of recording liquids to produce a mixed liquid with a desired density and/or color and transporting the mixed liquid to an image receiving medium to form an image. The actual value of the mixture proportion of the mixed liquid is constantly monitored in the vicinity of the confluent point of the recording liquids (in the vicinity of the downstream side of the confluent point or on the upstream side), and is compared with the target value of the mixture proportion obtained based on the image signal. And the supply amount of each recording liquid is subjected to feedback control in such a manner that the detected actual value agrees with the target value. The mixture proportion is prevented from fluctuating by influences of a recording liquid temperature, an atmospheric pressure, and the like and an image quality is enhanced.

15 Claims, 9 Drawing Sheets

METHOD AND APPARATUS FOR FORMING IMAGE WITH FEEDBACK CONTROL OF RECORDING LIQUID

BACKGROUND OF THE INVENTION

1. Field of the Invention

The present invention relates to an image forming method and apparatus for producing a fluid having a predetermined density and/or a predetermined color by changing a mixture proportion of a plurality of recording liquids (inks) based on an image signal and leading the fluid to an image receiving medium to form an image.

2. Description of the Prior Art

Unexamined Japanese Patent Publication (KOKAI) No. 232440/1995 (corresponding to U.S. Pat. No. 5,841,448) discloses an ink-jet recording head, in which an optical sensor is disposed in the recording head, and ink non-ejection or defective printing is prevented by detecting presence/absence of an ink in an ink channel. This also discloses that two electrodes are disposed in an ink tank, and the presence/absence of the ink in the ink tank is detected from a change of electric resistance between the electrodes.

Moreover, a method of changing a mixture proportion of a plurality of inks to change density or color, and forming an image has already been proposed. For example, U.S. Pat. No. 4,109,282 discloses a printer in which a valve called a flap valve is disposed in a flow channel for leading two liquids, that is, clear ink and black ink onto a substrate for forming an image. The flow channel of each ink is opened/closed by displacing this valve so that two liquids are mixed in a desired density and transported onto the substrate. This enables printout of an image having the same gray scale information as that of image information displayed on a TV screen. In this reference, it is disclosed that a voltage is applied between the flap valve and an electrode disposed on a surface opposite to the flap valve and the valve itself is mechanically deformed by an electrostatic attracting force to cause displacement of the valve. The ink is absorbed by a capillary phenomenon between fibers of a print paper.

U.S. Pat. No. 4,614,953 discloses an ink-jet printer head apparatus by which only a desired amount of a plurality of inks having different colors and solvent is led to a third chamber and mixed therein. In this reference is disclosed that a chamber and a diaphragm-type piezoelectric effect device attached to this chamber are used as means for check-weighing the desired amount of ink and a pressure pulse obtained by driving this piezoelectric device is used.

Unexamined Japanese Patent Publication (KOKAI) No. 201024/1993 discloses an ink jet print head including: a liquid chamber filled with a carrier liquid; ink jet driving means provided in the liquid chamber; a nozzle connected to the liquid chamber; and a mixer for mixing the carrier liquid in this nozzle with the ink. In this reference is also disclosed that adjusting means for adjusting a mixture amount of ink to provide a desired value is provided.

Similarly, Unexamined Japanese Patent Publication (KOKAI) No. 125259/1995 discloses an ink jet recording head including: first and second supply means for supplying inks having first and second densities, respectively; and control means for controlling a supply amount of the second ink by the second supply means so that a desired ink density can be obtained.

In this reference, a micro-pump which has an exclusive heating device and is driven by its heat energy is disclosed as the control means. As this micro-pump, there is disclosed an example such that the heat energy is generated by the heating device and a pressure obtained by nucleate boiling caused due to the heat energy is used to drive, for example, a piston-type valve or a cantilever-like valve. Further, this reference describes that an ink inflow can effectively be controlled in an area where the inflow is particularly small by adopting an actuator consisting of shape memory alloy for use in this valve.

Unexamined Japanese Patent Publication (KOKAI) No. 207664/1991 discloses an ink jet printer having a structure similar to that in the above-mentioned U.S. Pat. No. 4,614,953, but does not use a third chamber for mixing a plurality of inks.

Unexamined Japanese Patent Publication (KOKAI) No. 156131/1997 discloses an ink jet printer comprising a plurality of printer heads for forming an image having multiple colors based on image data. Ink and diluent are mixed at a predetermined mixture ratio to obtain a diluent ink, which is jetted from a nozzle so that a recording image is formed on a recording medium. The ink jet printer ejects the diluent from at least one printer head out of the plurality of printer heads when all-white image data, that is, data representing that mixture amount of ink is too small to realize a clear printing density, is inputted to the plurality of printer heads. As a result, a rapid tone change (a tone jump) is prevented and the additional consumption of the diluent is suppressed to improve drying characteristics.

As described above, various systems of mixing a plurality of recording liquids (inks) have been proposed, but in this case ejection amounts of respective recording liquids is are strongly influenced by a viscosity change with a temperature change, an atmospheric pressure change, and the like. Therefore, it has been difficult to accurately obtain target values of density and color of the mixed liquid. In the apparatus disclosed in the above mentioned U.S. Pat. No. 5,841,448, it is possible to detect non-ejection or printing defect from the presence/absence of each recording liquid or the mixed liquid. However, there is a problem that only the presence/absence of the respective recording liquids is detected and that a subtle fluctuation in the mixture proportion of the respective recording liquids cannot be detected.

SUMMARY OF THE INVENTION

The present invention has been accomplished under the aforementioned circumstances, and a first object of the present invention is to provide an image forming method of mixing a plurality of recording liquids to generate a mixed liquid with a desired density and/or color, and transporting the mixed liquid to an image receiving medium to form an image, so that a mixture proportion is prevented from fluctuating by influences of recording liquid temperature, atmospheric pressure, and the like and image quality can be enhanced. A second object is to provide an image forming apparatus for direct use in carrying out the method.

According to the present invention, the first object is attained by an image forming method for ejecting a mixed liquid constituted by a plurality of recording liquids from an ejection port while changing supply amounts of the respective recording liquids based on an image signal, and transporting the mixed liquid to an image receiving medium to form an image, said method comprising steps of:

determining a target value of a mixture proportion of said plurality of recording liquids based on said image signal;

controlling the supply amounts of the respective recording liquids in such a manner that the mixture proportion of the recording liquids agrees with the target value;

detecting an actual value of the mixture proportion in the vicinity of a confluent position of said plurality of recording liquids; and comparing the detected actual value with said target value to perform a feedback control of the supply amounts of the respective recording liquids in such a manner that there is no difference between both values.

In this case, the actual value of the mixture proportion can be detected in the vicinity of a position where the recording liquids are combined (confluent point or position), for example, in the vicinity of a right downstream portion. Specifically, the actual value is detected in a range of a channel length of the mixed liquid capacity for one pixel to a downstream side from the confluent point. The recording liquid can usually be regarded as a non-compressive fluid. Therefore, by detecting the mixture proportion from the confluent point until each recording liquid for one pixel is completely supplied, the supply amount of each recording liquid for one pixel can be fed back in real time. Therefore, the actual mixture proportion for each pixel can exactly be controlled.

The mixture proportion of the respective recording liquids can be detected based on an optical density, electric resistance, electrostatic capacity, and the like of the mixed liquid. In this case, it is assumed that the respective liquids different in density, electric resistance, and permittivity are mixed. For example, two liquids are preferably mixed.

The actual value of the mixture proportion may be estimated by detecting an actual supply amount of each recording liquid. In this case, by separately detecting the supply amounts (flow rate, flow velocity) of the respective recording liquids on an upstream side from the confluent point of the plurality of recording liquids, and obtaining a volumetric ratio, i.e., mixture proportion of the recording liquids, a result can be regarded as the actual value. The supply amount of each recording liquid can be obtained by optically detecting displacement of a movable member for controlling the supply amount, or can be detected from the electrostatic capacity which changes by the displacement of the movable member. Moreover, the supply amount can be detected by a pressure change in a recording liquid channel, or by a thermal flow rate measurement system.

The supply amount of the recording liquid is preferably corrected by a recording liquid temperature. The recording liquid temperature can be detected by a thermistor whose electric resistance changes by temperature or another temperature sensor or a thermocouple.

The supply amount of the recording liquid can also be detected by the displacement of the movable member disposed in flow rate control means of the recording liquid. The displacement of the movable member can optically be detected or can be detected by an electrostatic capacity change. By detecting environmental states in the vicinity of the ejection port of the mixed liquid, such as outside air temperature and atmospheric pressure, and the actual value or the target value of the mixture proportion is corrected. Based on the corrected actual or target value, the supply amounts of the respective recording liquids is corrected, thereby detection precision can further be enhanced.

By transporting or transferring the mixed liquid as a continuous fluid flow to the image receiving medium from the ejection port, the image can be formed (continuous coating mode). Moreover, the mixed liquid can also be transported or flied as a liquid droplet to the image receiving medium. In these cases, the mixed liquid may directly be transported to the image receiving medium from the ejection port, or transported to a final image receiving medium via an intermediate image receiving medium.

The second object of the present invention is attained by an image forming apparatus for ejecting a mixed liquid constituted by a plurality of recording liquids from an ejection port while changing supply amounts of the respective recording liquids based on an image signal, and transporting the mixed liquid to an image receiving medium to form an image, said apparatus comprising:

recording liquid flow rate control means for individually controlling the supply amounts of the respective recording liquids;

actual value detecting means for detecting an actual value of a mixture proportion of the plurality of recording liquids;

a target value processor for obtaining a target value of the mixture proportion of the respective recording liquids in accordance with the image signal;

a supply amount controller for determining the supply amounts of the respective recording liquids in such a manner that the actual value of said mixture proportion agrees with said target value; and a driver for driving said recording liquid flow rate control means based on an output of said supply amount controller.

The actual value-detecting means can be constituted in such a manner that the actual value of the mixture proportion is obtained by calculation based on an optical density detected by a density sensor disposed in a mixed liquid channel. Instead of detecting the optical density of the mixed liquid, the actual value of the mixture proportion may be obtained by calculation in accordance with the electric resistance change, or the electrostatic capacity change of the mixed liquid.

The actual value detecting means can be constituted to detect the supply amounts of the respective recording liquids on the upstream side from the confluent point of the plurality of recording liquids, and obtain the mixture proportion from the result. In this case, as a sensor for detecting the supply amount, an optical sensor, a sensor for detecting an internal pressure change, a sensor by a thermal flow rate measurement system, and the like can be used. Moreover, the sensor may optically detect the displacement of the movable member disposed in an actuator of the recording liquid flow rate control means, or detect the electrostatic capacity change with the displacement of the movable member.

In order to control the supply amount or flow rate of the recording liquid, for example, a diaphragm-type flow control valve driven by a piezoelectric device, an electrostatic attraction force, an electrostatic repulsive force, or the like may be disposed in a plurality of recording liquid channels. In this case, a recording liquid supply pressure to the recording liquid channel is, of course, always kept to be constant. Additionally, a discharge amount of the feed pump for supplying the recording liquid to the recording liquid channel can be controlled, without using the flow control valve. Preferably, such pump is of a volumetric capacity type, and driven by a pulse motor. Instead of the pulse motor, the recording liquid feed pump may be formed by a piezoelectric device and a check valve. In this case, the driving may be performed by the electrostatic attraction force or the electrostatic repulsive force instead of the piezoelectric device.

The ejection ports for ejecting mixed recording liquids can be disposed for respective pixels arranged in a width direction of the image receiving medium, and can independently be disposed opposite to the image receiving medium. The mixed liquid droplet can be transported to the image receiving medium by an ink jet mode. Moreover, the image receiving medium may be coated with the mixed liquid by the continuous coating mode. In the continuous coating mode, the fluid (mixed liquid) ejected or extruded from the ejection port of each mixed liquid can be led to the image receiving medium through a slot opening which is elongated in a width direction of the image receiving medium. By using the slot opening is this manner, a flow of the liquid can be further stabilized as a steady flow to be led to the image receiving medium.

In the ink jet mode or the continuous coating mode, the liquid ejected from the mixed liquid ejection port can be transported to the intermediate image receiving medium such as a transfer drum, and the liquid can be further transported from the intermediate image receiving medium onto the final image receiving medium such as recording or print paper. As described above, the mixed liquid ejected from the mixed liquid ejection port can be smoothly transferred by using the intermediate image receiving medium, and deteriorated image quality due to the unevenness of the image receiving medium (final image receiving medium) such as print paper can be prevented from occurring.

In the image forming method and apparatus of the present invention, the actual value of the mixture proportion of the mixed liquid is constantly monitored in the vicinity of the confluent point of the recording liquids (in the vicinity of the downstream side of the confluent point or on the upstream side), and is compared with the target value of the mixture proportion obtained based on the image signal. And the supply amount of each recording liquid is subjected to feedback control in such a manner that the detected actual value agrees with the target value. While the recording liquids for forming the mixed liquid necessary for forming one pixel are supplied from the respective recording liquid channels, the supply amounts of the respective recording liquids are controlled to be corrected for the same pixel in real time. Therefore, the mixture proportion can always accurately be controlled, and the image quality is enhanced.

In the present invention, the image formed on the image receiving medium includes graphical intelligence patterns such as alphanumeric characters, graphical display, line art, and other image information.

DESCRIPTION OF THE PREFERRED EMBODIMENTS

First Embodiment

Figure 1:
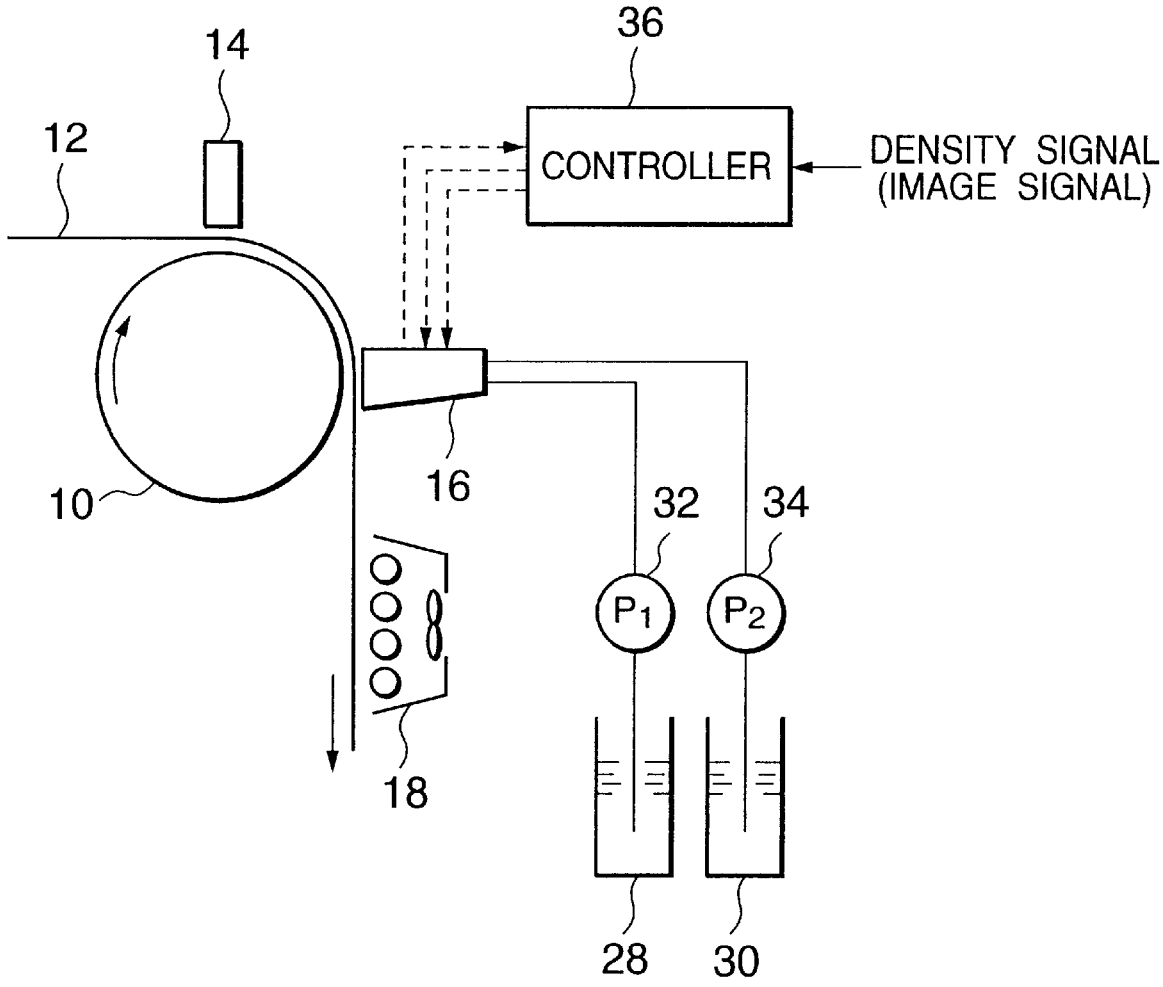
FIG. 1 is a schematic view of an image forming apparatus according to a first embodiment of the present invention to which a continuous coating mode is applied.

An embodiment adopted to a continuous coating mode will be described hereinafter with reference to FIGS. 1 and 2. In FIG. 1, reference numeral 10 denotes a platen, and 12 denotes a print paper as an image receiving medium wound around the platen 10. The print paper 12 is fed in a direction of an arrowhead at a fixed speed by clockwise rotation of the platen 10 on the figure.

Numeral 14 denotes an undercoating section for applying a transparent undercoating liquid onto the print paper 12 in order to enhance adherability of a recording liquid, i.e., an ink and to improve an image quality. Numeral 16 is a recording head for forming an image on the print paper 12. First and second inks are mixed or combined in the recording head 16 and led to the print paper 12. Numeral 18 is a heater for heating the print paper 12 on which the image is formed by the recording head 16 so that the ink is dried out.

Figure 2:
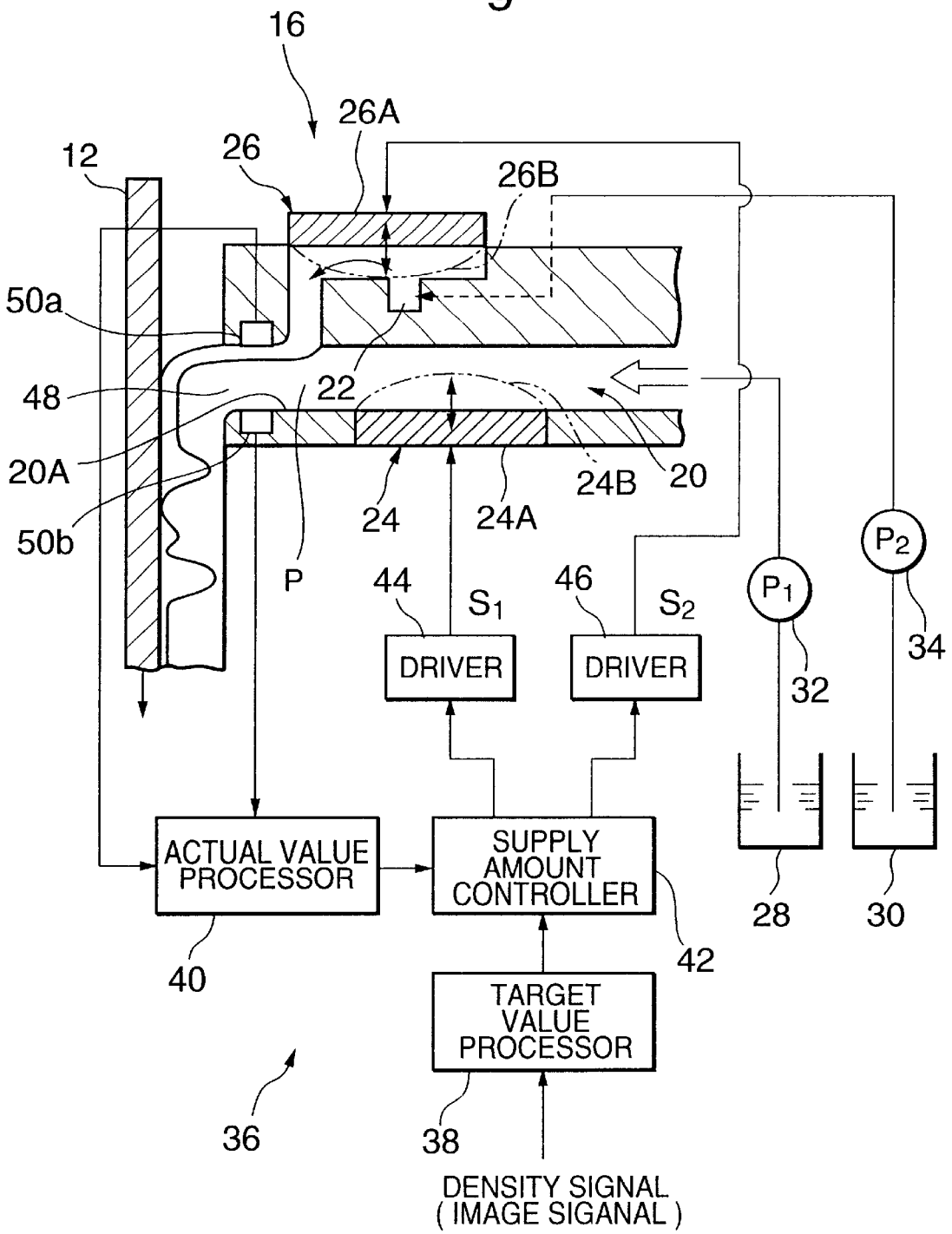
FIG. 2 is an enlarged sectional view of an image forming section (recording head) for use in the image forming apparatus of FIG. 1.

As shown in FIG. 2, the recording head 16 includes: a first ink channel 20; a second ink channel 22; and flow control valves 24 and 26 as ink (recording liquid) flow rate control means for changing channel cross section areas of the respective channels 20 and 22. The first ink is a colorless and transparent ink, that is, an ink which is transparent and colorless or becomes colorless and transparent when dried out. The first ink contains decoloration preventing agents such as antioxidant and ultraviolet ray absorber. The second ink is an image forming ink for finally forming an image, for example, a black ink.

The formed image is not limited to a visually recognizable image. With an electromagnetically perceptible image, for example, with a magnetic image, the second ink is a magnetic ink, and the first ink is provided with no magnetism.

The first and second inks are respectively contained in ink tanks 28 and 30, and fed to the first and second ink channels 20 and 22 with a fixed pressure from the ink tanks 28 and 30 by ink feed pumps 32 and 34. As the pumps 32 and 34 used in this embodiment, those having a structure in which a pressure adjusting valve is provided on the ink discharge side (the side of the outlet port of the pump) to maintain the ejection pressure constant is suitable.

Flow control valves 24, 26 are driven, for example, by a piezoelectric device, and diaphragms 24B, 26B as movable members are moved into/from the ink channels 20, 22 by drive forces of actuators 24A, 26A, respectively. These actuators 24A, 26A are controlled by a controller 36 (FIG.

1) in such a manner that an actual value of a mixture proportion agrees with a target value as described later.

The controller 36 includes a target value processor 38, an actual value processor 40, a supply amount controller 42, and drivers 44, 46 as shown in FIG. 2. The target value processor 38 calculates the mixture proportion of the first and second inks ($S_1/S_2$) based on a density signal (image signal) to obtain target values $S_1$, $S_2$ of the supply amounts of the respective inks. The supply amounts $S_1$ and $S_2$ of the first and second inks are determined so that a sum ($S_1+S_2$) becomes-a fixed amount $S_0$. By keeping the supply amount ($S_1+S_2$) of the mixed liquid at the fixed amount $S_0$, transport of the liquid fluid to the image receiving medium can be stabilized.

The respective inks are combined at a confluent point or position P (FIG. 2) of the first and second ink channels 20, 22, and the mixed liquid flows downward in the channel 20, and is ejected from an ejection port 48. Therefore, a mixed liquid channel 20A is formed on the downstream side from the confluent point P of the channel 20. The mixed liquid channel 20A is provided with a density sensor 50 (50*a*, 50*b*). The density sensor 50 can optically measure an optical density (light transmittance). In this case, a light emitting element 50*a* is disposed opposite to a light receiving element 50*b* across the channel 20A. Or, the elements 50*a*, 50*b* may be provided on the same side of the channel 20A. The light emitted from the element 50*a* is reflected by the inner wall surface of the channel 20A and the reflected light is detected by the element 50*b*. The density sensor 50 is disposed within a channel length of a mixed liquid capacity for one pixel on the downstream side from the confluent point P.

The actual value processor 40 calculates an actual value ($S_1'/S_2'$) of mixture proportion of respective inks from the mixed liquid optical density detected by the density sensor 50. The ejection amount controller 42 compares the actual value ($S_1'/S_2'$) of the mixture proportion with the target value ($S_1/S_2$), and corrects the respective ink supply amounts $S_1$, $S_2$ in such a manner that the actual value agrees with the target value. Moreover, the drivers 44, 46 drive the actuators 24A, 26A so that the respective ink ejection amounts indicate corrected supply amounts $S_1''$, $S_2''$. A total supply amount ($S_1''+S_2''$) is set to the fixed value $S_0$.

The actuators 24A and 26A are driven by a pulse as described later, and pulse number and pulse voltage (or current) control the number of opening/closing times and open degrees of the diaphragms 24B and 26B, so that flow rates $S_1''$ and $S_2''$ are controlled. In this case, if channel resistance of the ink channels 20, 22, ink feed pressure, a condition for opening/closing the diaphragms 24B, 26B, and other conditions are satisfied, a total flow rate $S_0=S_1''+S_2''$ can be managed to be constant by controlling in such a manner that a sum of pulse number of the actuators 24A, 26A is fixed.

The first and second inks whose flow rates are controlled in this manner are combined at the confluent point P of the first and second channels 20, 22 to form a mixed flow, and ejected as a continuous flow from the ejection port 48. The ejected mixed liquids flow is continuously applied to the print paper 12 which is disposed close to and opposite to the ejection port 48. In this case, the total ejection flow rate $S_1''+S_2''=S_0$ is controlled to be constant by the drive pulse number and voltage (current) for driving the actuators 24A, 24B. Accordingly, the ink can smoothly and steadily be applied to the print paper 12. In this embodiment, the first and second inks are applied as a laminar flow having no distortion without being mixed with each other as shown in FIG. 2.

Here, the laminar flow includes a flow which is mixed only in the vicinity of a border between the first and second inks. Although the first and second inks may uniformly be mixed, the surface of an image formed on the print paper 12 can be covered with either ink (the first ink in this example) by constituting the laminar flow in this manner. When either ink (the second ink in this example) has conformability to an undercoating layer on the print paper 12, the image quality can be improved.

When a plurality of sets of the first and second ink channels 20, 22 and flow control valves 24, 26 are provided to be aligned in a width direction of the print paper 12 (a direction perpendicular to a moving direction) and they are disposed for respective pixels, the image can be formed by controlling the flow control valves 24, 26 for the respective pixels in accordance with the density signal (image signal). In such a case, the ink ejection port 48 can independently be disposed opposite to the print paper 12 for each pixel. Further, these ink ejection ports 48 can be formed in a slot-shaped opening elongating in the width direction of the print paper 12, and the ink liquid constituted by the first and second inks can be zonally transported and applied onto the print paper 12 from this slot opening.

Second Embodiment

Figure 3:
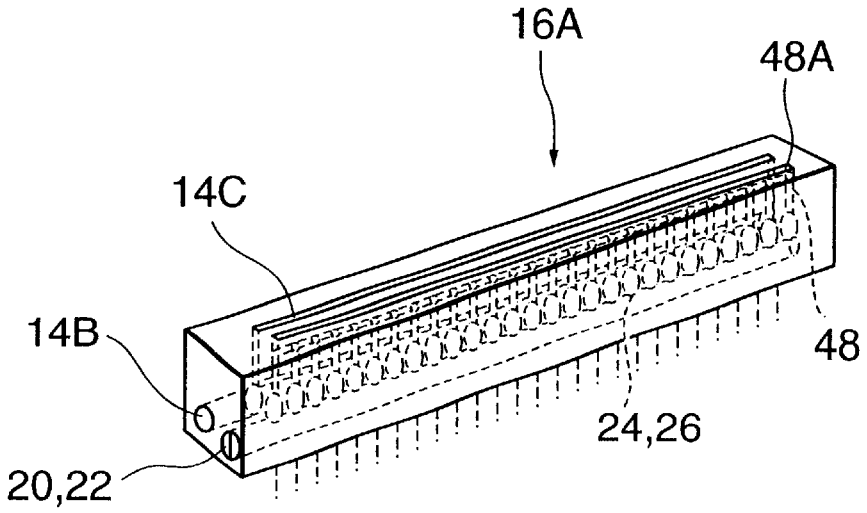
FIG. 3 is a perspective view showing the image forming section (recording head) for zonally transporting an ink to a print paper according to a second embodiment of the present invention.

FIG. 3 is a perspective view showing a recording head 16A used in a second embodiment for performing continuous zonal application as described above, and FIG. 4 is an enlarged sectional view showing an application state. The recording head 16A includes ink ejection ports 48 which are independent for respective pixels and a slot opening 48A which is parallel to the ink ejection ports 48 for the respective pixels, and the ink liquid continuously ejected from each ink ejection port 48 zonally congregates as the laminar flow in the slot opening 48A and is ejected or extruded on the print paper 12.

An undercoating section 14A is integrally incorporated in the recording head 16A. The undercoating section 14A includes an undercoating liquid channel 14B parallel to the first and second ink channels 20, 22 and a slot-opening 14C which is parallel to the slot 48A. Since an undercoating liquid L is colorless and transparent and used for a preliminary treatment in order that the ink can stably adhere to the surface of the print paper 12, the slot opening 14C is positioned on the upstream side of the slot 48A of the recording head 16A with respect to the moving direction of the print paper 12.

Figure 4:
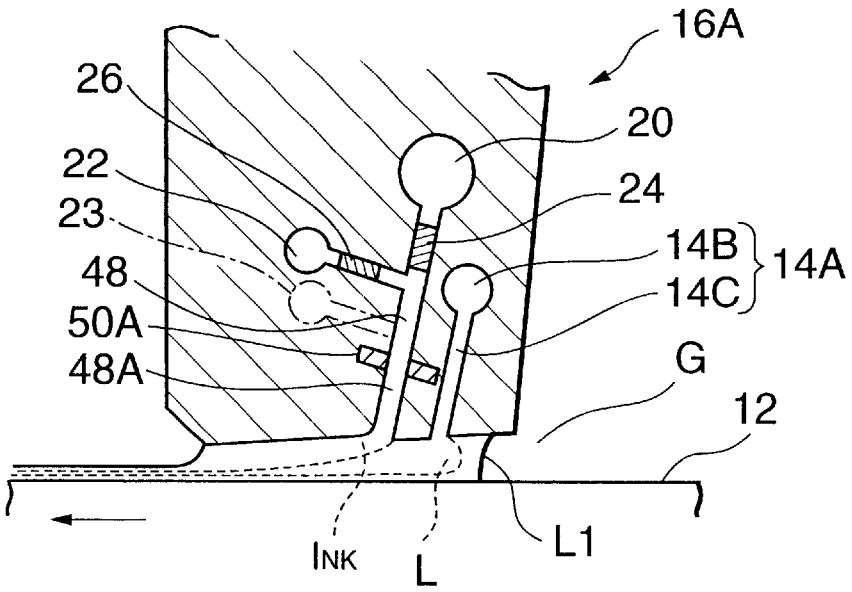
FIG. 4 is an enlarged sectional view showing a coating state by the recording head of FIG. 3.

The undercoating liquid L has a function of preventing turbulence or whirlpool from occurring in the flow of a mixed liquid $I_{NK}$ during continuous application of the mixed liquid $I_{NK}$ and improving the image quality. Specifically, as shown in FIG. 4, a part of the undercoating liquid L which has been just ejected from the slot 14C flows to the upstream side of the slot 14C to form a liquid pool or bead $L_1$ in a gap G formed between the recording head 16A and the print paper 12. A whirlpool of the undercoating liquid L may be generated in the liquid pool $L_1$, but the undercoating liquid L is transparent and therefore fails to adversely affect a coating surface.

The undercoating liquid L comes in front of the slot 48A as a stable laminar flow having a fixed thickness in consequence with movement of the print paper 12. Accordingly, the mixed liquid $I_{NK}$ ejected from the slot 48A is loaded onto the laminar flow of the undercoating liquid L and applied. Therefore, the image quality can be improved without generating distortion or whirlpool in the flow of the mixed liquid $I_{NK}$.

A third ink channel 23 may be provided in the recording head 16A. A third ink supplied from the third ink channel 23 is led to the ink ejection port 48 through a flow control valve (not shown) and transported to the print paper 12 together with the first and second inks. When the third ink channel 23 is disposed, color inks of yellow, magenta and cyan are supplied-to the first, second and third ink channels 20, 22 and 23, respectively, a mixture ratio of the inks is varied, and a color image can thus be formed.

When the color image is formed, a sensor 50A which can detect not only the density but also a mixed liquid color is disposed in the mixed liquid channel, and the actual value processor 40 (see FIG. 2) calculates the actual values of the density and color. Moreover, the ejection amount controller 42 (see FIG. 2) corrects the target value of each ink supply amount. Such color sensor 50A is obtained by combining three sensors which detect respective color densities, for example, through a color filter.

Third Embodiment

Figure 5:
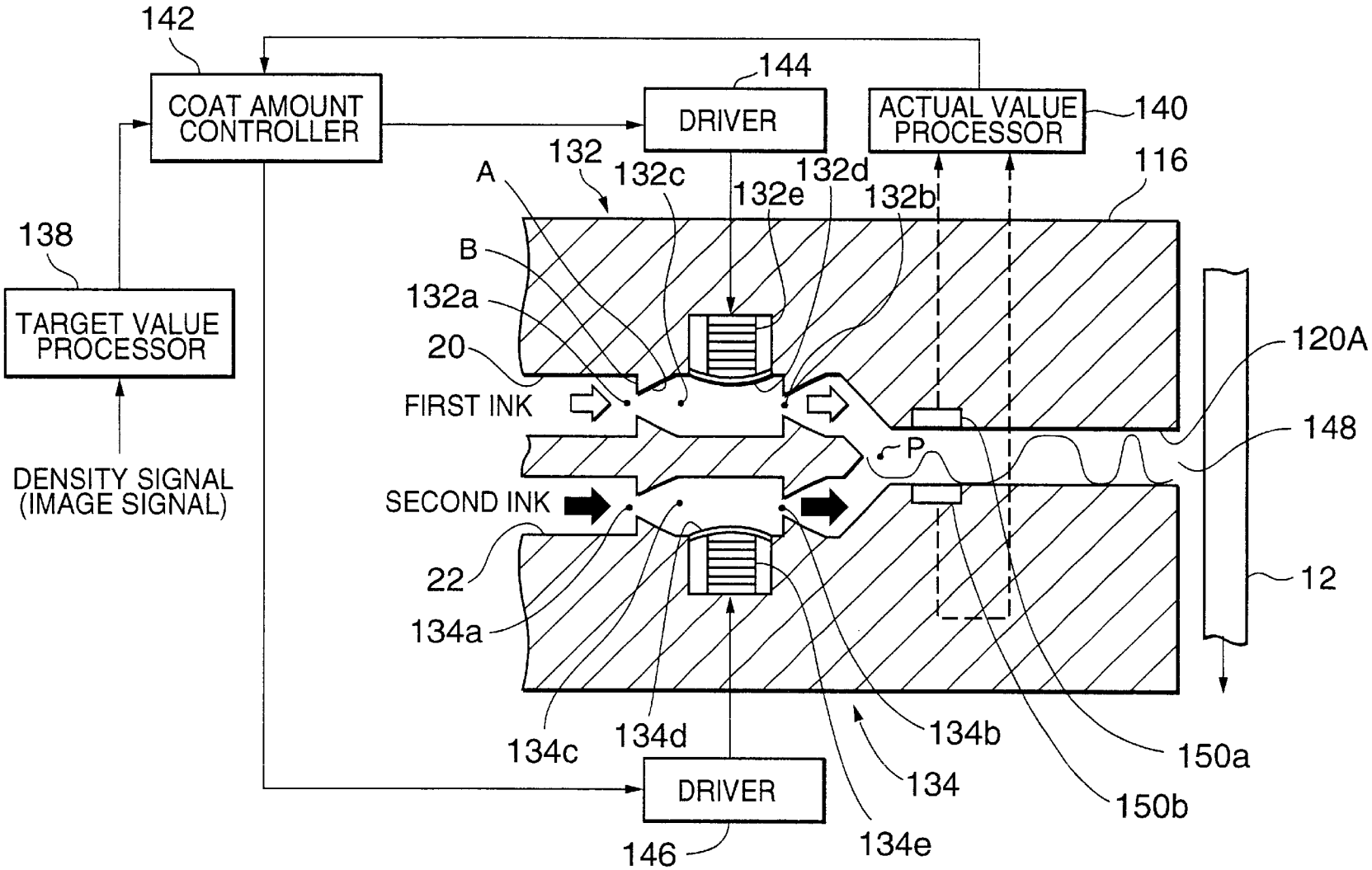
FIG. 5 is a sectional view showing the image recording head according to a third embodiment of the present invention.
Figure 6:
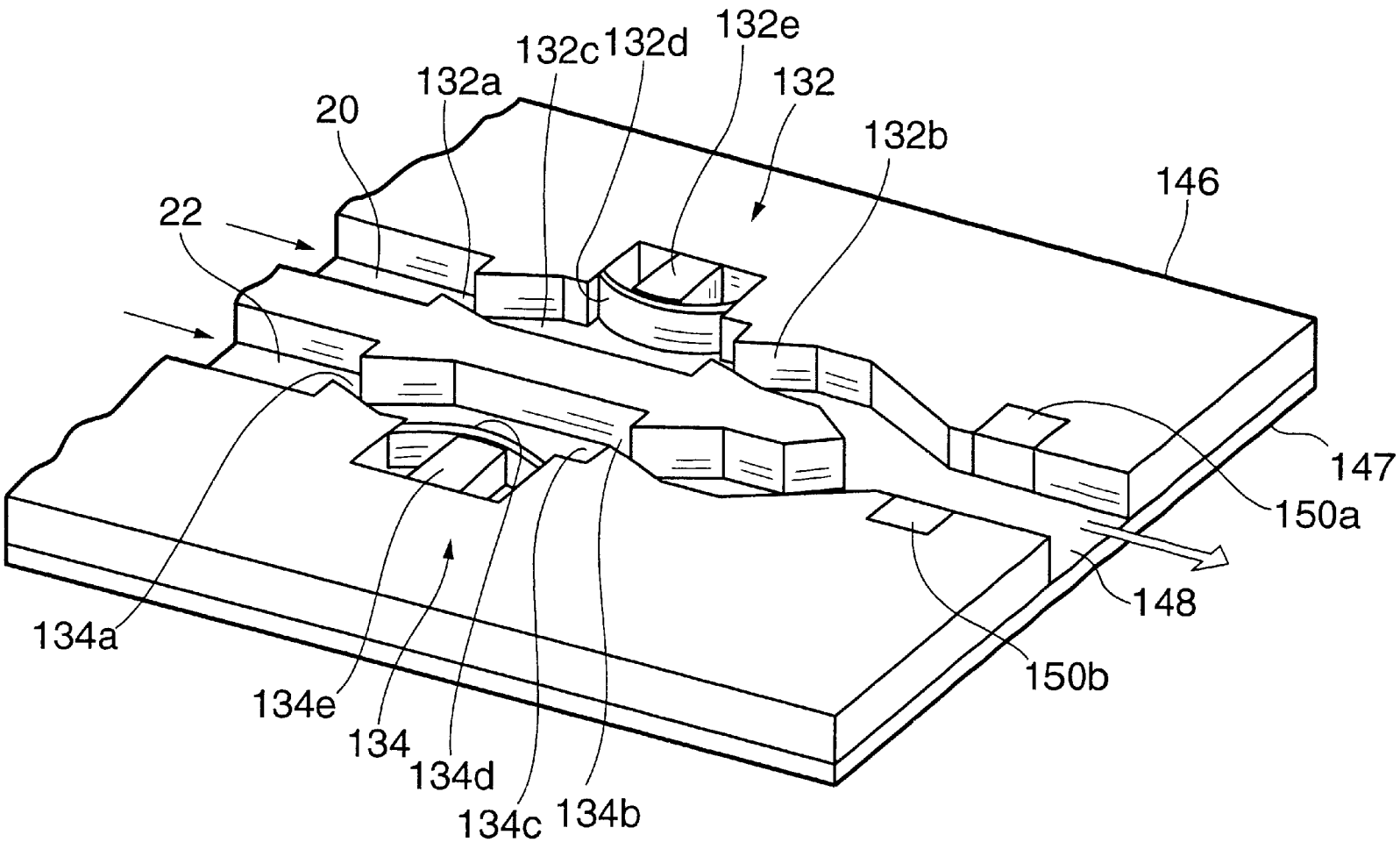
FIG. 6 is an exploded perspective view of the recording head of FIG. 5.

FIG. 5 is a sectional view showing an image recording head 116 by the continuous coating mode according to a third embodiment, and FIG. 6 is an exploded perspective view of the recording head 116. In the embodiment, instead of the ink feed pumps 32, 34 and flow control valves 24, 26 in FIGS. 1, 2, ink feed pumps 132, 134 are used. The pumps 132, 134 are formed on a common substrate 146, and the respective substrates 146 are laminated via partition plates 147.

The pumps 132, 134 comprise: check valves 132*a*, 132*b* and 134*a*, 134*b*; cavities 132*c*, 134*c* formed between the check valves 132*a*, 132*b* and between the check valves 134*a* and 134*b*, respectively; diaphragms 132*d*, 134*d* disposed opposite to the cavities 132*c*, 134*c*, respectively; and actuators 132*e*, 134*e* for driving the diaphragms 132*d*, 134*d*, respectively.

The check valves 132*a*, 132*b* and 134*a*, 134*b* are formed in throttle shapes such that conductance (inverse number of resistance) changes along an ink flow direction with respect to the cavities 132*c*, 134*c*. Specifically, the check valves 132*a*, 132*b*, 134*a*, 134*b* are formed as restrictions or throttles having a geometrical shape such that the conductance along the ink flow direction is larger than that in a reverse direction. Therefore, each check valve has no movable portion and can readily be manufactured by a method of manufacturing a micro-machine. Since the four check valves 132*a*, 132*b*, 134*a*, 134*b* have the same structure, the structure will be described using one check valve 132*a*.

The check valve 132*a* has an inclined surface A whose ink channel section area substantially-continuously increases in the ink flow direction (from the left side toward the right side in FIG. 5), and a flat surface B whose ink channel section area rapidly increases in the reverse direction. An operation of the check valve 132*a* will qualitatively be described. First, when the ink flows from the left side to the right side on FIG. 5, the ink passes through the throttle and flows as a steady flow along the inclined surface A. In this case, pressure loss and flow resistance are reduced. Conversely, when the ink flows toward the left side from the right side, the ink flows through the throttle, rapidly expands by the flat surface B and forms a turbulence. Therefore, the pressure loss and flow resistance are enlarged. Additionally, since the flow direction might be reversed depending on a throttle angle, a throttle direction is reversed to solve this problem.

The cavities 132*c*, 134*c* with variable capacities are present between the check valves 132*a* and 132*b* and between the check valves 134*a* and 134*b*, respectively. The capacities of the cavities 132*c*, 134*c* change by the diaphragms 132*d*, 134*d* driven by the actuators 132*e*, 134*e*. As the actuators 132*e*, 134*e*, a piezoelectric device, and a magnetostrictive device are preferable, and particularly the piezoelectric device using lead zirconate titanate (PZT; a solid solution of lead titanate and lead zirconate), barium titanate ($BaTiO_3$), a solid solution of PZT and barium titanate, and the like is more preferable.

Instead of utilizing the piezoelectric effect or the magnetostrictive effect, the actuators 132*e*, 134*e* may utilize other effects. A heat-pressure effect, electrostatic attracting force or electrostatic repulsive force, effect of interfacial waved force of fluids other than a plurality of fluids for use in image formation, bubble generated by electrolysis and/or heat of the fluids other than the plurality of fluids for use in the image formation, effect of changing a liquid pressure by changing a channel resistance of the fluids other than the plurality of fluids for use in image formation, and the like may be utilized for the actuators 132*e*, 134*e*.

When the capacities of the cavities 132*c*, 134*c* vary by movement of the diaphragms 132*d*, 134*d*, the ink reciprocates through the check valve. The resistance decreases when the ink flows rightward in FIG. 5, and the resistance increases when the ink flows in a reverse direction (leftward). Therefore, by continuous capacity changes of the cavities 132*c*, 134*c*, the ink flows in a direction in which the resistance decreases. Thus the check valve functions is served. Additionally, one check valve may be disposed in the ink channel, but by disposing the check valves on both sides of the cavities 132*c*, 134*c* as in the embodiment, pump function is further enhanced.

With such construction, when the actuators 132*e*, 134*e* are driven, the capacities of the cavities 132*c*, 134*c* change, and the ink flows toward an ink ejection port 148. Therefore, by controlling the drive pulse number and voltage (current) to be applied to the actuators 132*e*, 134*e*, the ejection (supply) amounts of the first and second ink can be controlled.

As seen in FIG. 5, a mixed liquid channel 120A is formed on the downstream side of the confluent point P of the first and second inks, and a density sensor 150 (150*a*, 150*b*) is disposed in the channel 120A. The sensor 150 is the same as the density sensors 50, 50A (see FIGS. 2, 4), numeral 150*a* is a light emitting element, and 150*b* is a light receiving element. An actual value processor 140 obtains the mixture proportion of the mixed liquid based on an output of the light receiving element 150*b*. Since the constitution and function of a target value processor 138, coat amount controller 142, drivers 144, 146 are the same as those of the processor 38, controller 42, drivers 44, 46 described with reference to FIG. 2, respectively, the description thereof is not repeated.

Fourth Embodiment

Figure 7:
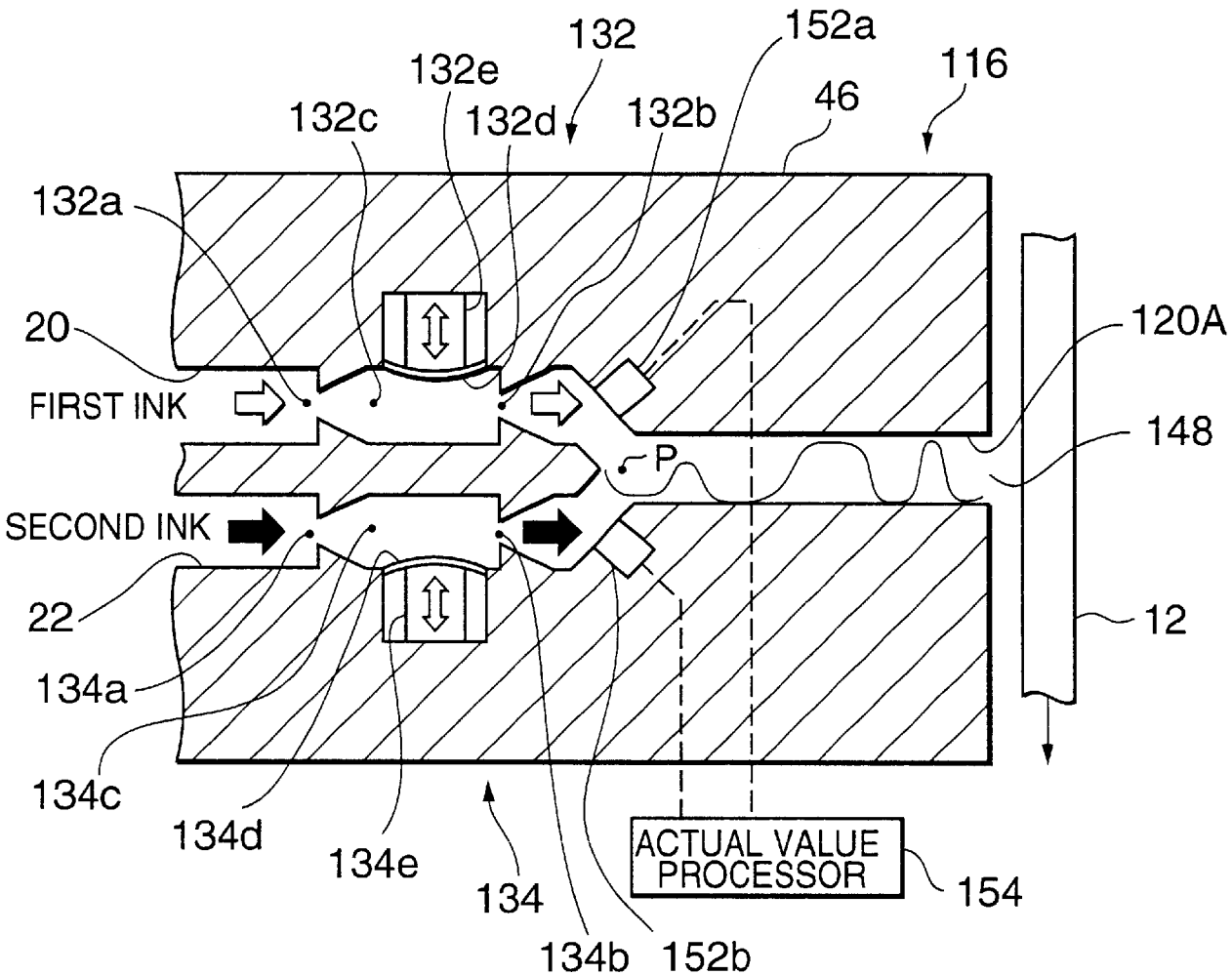
FIG. 7 is a sectional view showing the image recording head according to a fourth embodiment of the present invention.

FIG. 7 is a sectional view showing the recording head according to a fourth embodiment, and corresponds to FIG. 5. FIG. 7 is different from FIG. 5 in that instead of the density sensor 150, an ejection or supply amount sensor 152 (152*a*, 152*b*) is disposed in the respective ink channels 20, 22 on the upstream side of the confluent point P.

The ejection or supply amount sensors 152*a*, 152*b* detect the flow rate of the ink which flows through the ink channels 20, 22 in a position close to (immediately before) the confluent point P. Outputs of the sensors 152*a*, 152*b* are inputted to an actual value processor 154, and the processor 154 calculates the actual value of the mixture proportion of the mixed liquid from a flow ratio of the respective inks.

Thus obtained actual value of the mixture proportion is transmitted-to the coat amount controller 142 shown in FIG. 5, and the supply amount of the respective inks is controlled in such a manner that the actual value agrees with the target value. Additionally, since the same portions as those of FIG. 5 are denoted with alike reference numerals in FIG. 7, the description thereof is not repeated.

As the supply amount detecting sensor 152 for detecting the supply amount of the ink (recording liquid) on the upstream side of the confluent point P, an optical sensor for optically and directly detecting the flow rate, an optical sensor for optically detecting the displacement of the flow-rate controlling movable member, an electrostatic capacity sensor for detecting the electrostatic capacity by the movable member displacement, a pressure sensor for detecting a change of an internal pressure in the ink channel, a sensor by a thermal flow rate measurement system, and other various sensors can be used.

Fifth to Ninth Embodiments

Figure 8:
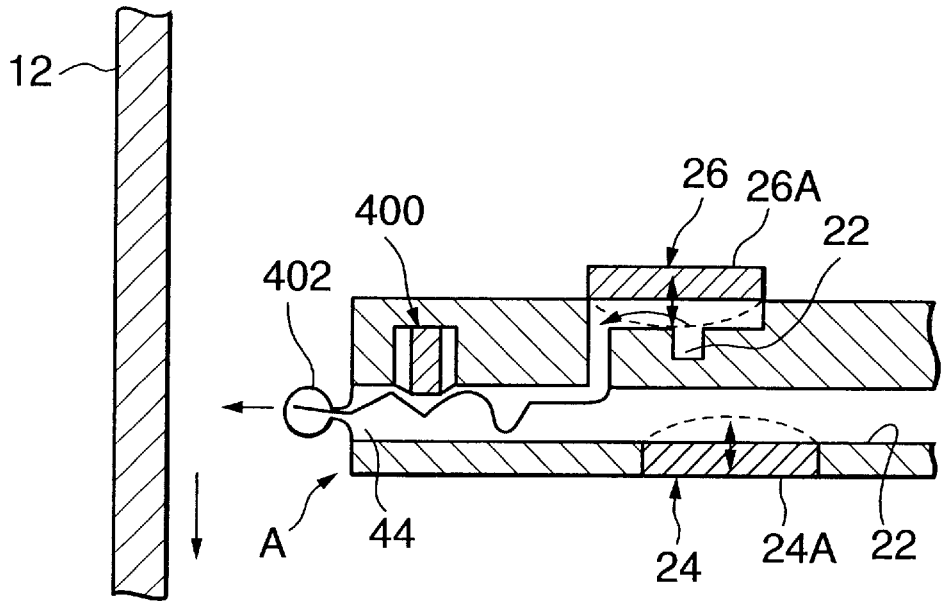
FIG. 8 is a sectional view showing the image forming section (recording head) according to a fifth embodiment having ink transport means to which a piezo ink jet mode is applied.
Figure 9:
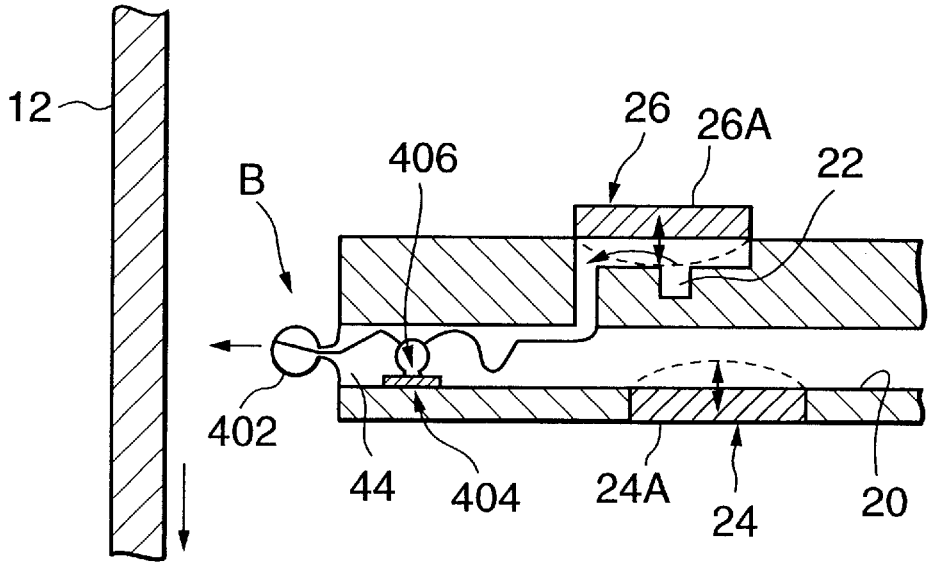
FIG. 9 is a sectional view showing the image forming section (recording head) according to a sixth embodiment having ink transport means to which a thermal ink jet mode is applied.
Figure 10:
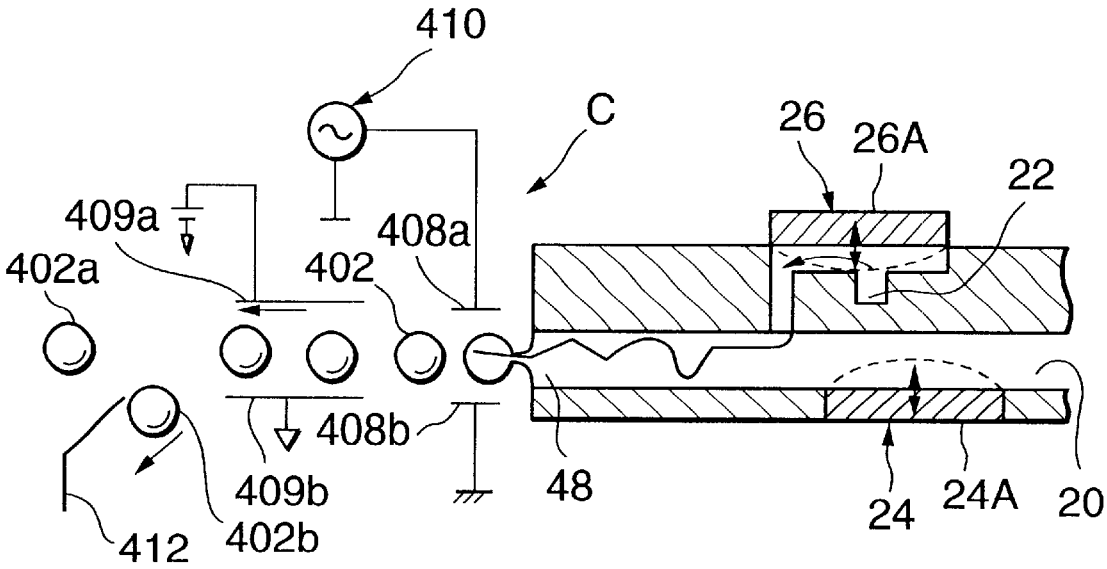
FIG. 10 is sectional view showing the image forming section (recording head) according to a seventh embodiment having ink transport means to which a continuous ink jet mode is applied.
Figure 11:
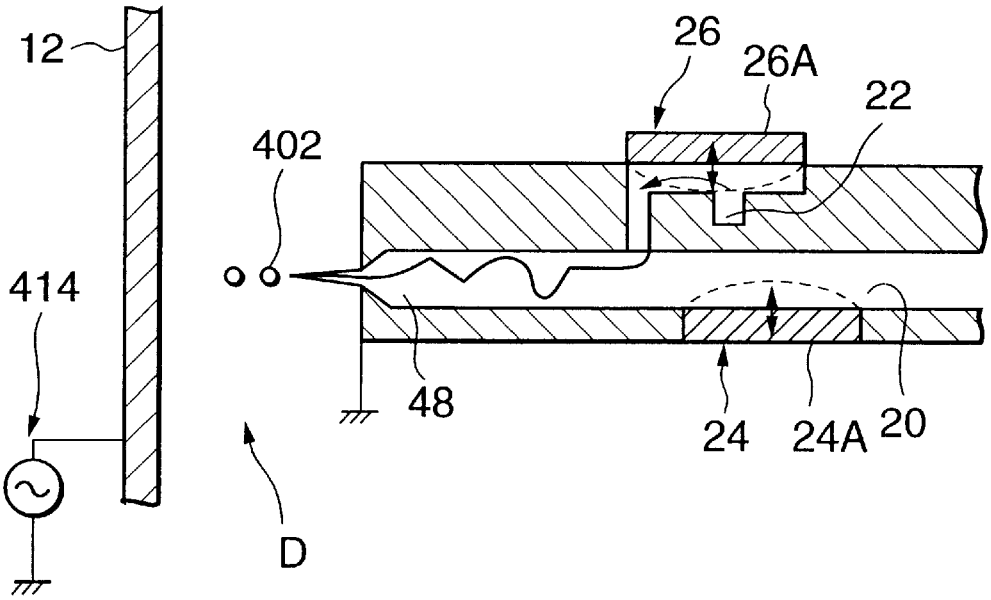
FIG. 11 is a sectional view showing the image forming section (recording head) according to an eighth embodiment having ink transport means to which an electrostatic attraction ink jet mode is applied.
Figure 12:
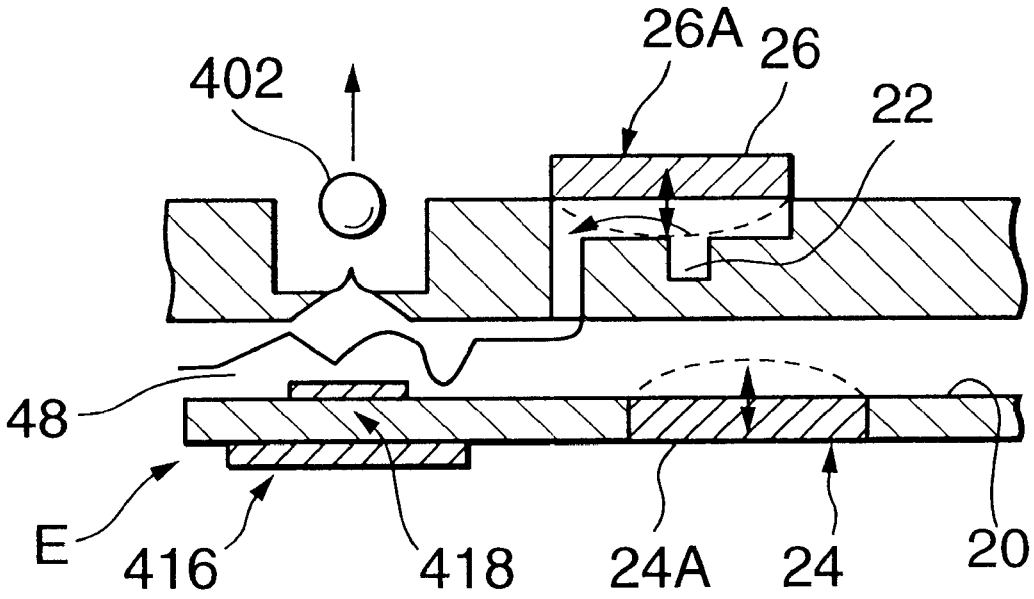
FIG. 12 is a sectional view showing the image forming section (recording head) according to a ninth embodiment having ink transport means to which an ultrasonic ink jet mode is applied.

FIGS. 8 to 12 show the image recording head provided with ink transport means by an ink jet mode according to fifth to ninth embodiments. FIG. 8 shows a piezo ink jet mode, FIG. 9 shows a thermal ink jet mode, FIG. 10 shows a continuous ink jet mode, FIG. 11 shows an electrostatic attraction ink jet mode, and FIG. 12 shows an ultrasonic ink jet mode.

In these embodiments, the first and second inks controlled by the flow control valves 24, 26 similar to those in FIG. 2 are led to the ink ejection port 48. The ink transport means A of FIG. 8 ejects or jets the ink (mixed liquid) as an ink droplet 402 using a piezoelectric ejection device 400 disposed in the vicinity of the ink ejection port 48, and leads the droplet onto the print paper 12.

The ink transport means B of FIG. 9 generates a bubble 406 by heating the ink liquid (mixed liquid) by a heater 404 disposed in the vicinity of the ink ejection port 48 in order to eject or jet the ink droplet 402. In the ink transport means C in FIG. 10, a high voltage in accordance with the image signal is applied between electrodes 408 (408*a*, 408*b*) disposed before the ink ejection port 48 by an oscillator 410. As a result, an electric charge in accordance with the image signal is imparted to the ink droplet 402 drawn from the ink ejection port 48. The ink droplet is deflected by deflection electrodes 409 (409*a*, 409*b*) so that only a necessary droplet 402*a* is led to the print paper 12 while removing an unnecessary liquid droplet 402*b* by a baffle plate 412.

The ink transport means D of FIG. 11 narrows down the ink ejection port 48 to a small diameter and applies a high voltage in accordance with the image signal between the ink ejection port 48 and the print paper 12 by an oscillator 414. The high voltage is used to draw the ink droplet 402 from the ink ejection port 48 so that the ink droplet is attracted to the print paper 12. In the ink transport means E of FIG. 12, By an ultrasonic transducer 416 is disposed on the outer wall of the ink ejection port 48, and an ultrasonic wave emitted from the ultrasonic transducer 416 is converged on the ink liquid by a Fresnel lens 418 disposed on the inner wall of the ink ejection port 48 to excite the ink liquid so that the liquid droplet 402 is generated.

In the ink jet mode shown in FIGS. 8 to 12, the flow control valves 24, 26 driven by the actuators 24A, 26A are used, and the ink having the ejection amount controlled by the actuators 24A, 26A is ejected as an ink jet using-the ink transport means A to E separate from the actuators 24A, 26A. However, the ink may directly be ejected as the ink jet from the similarly constituted actuators 24A, 26A, and this is included in the present invention. Moreover, instead of the flow control valves 24, 26, the ink feed pumps 132, 134 shown in FIGS. 5 to 7 may be used.

In the aforementioned embodiments, the actuators 24A, 26A, 132*e*, 134*e* of the recording liquid flow rate control means are formed using the piezoelectric device, but actuation may be performed in other modes. Moreover, as the sensor for detecting the mixture proportion, instead of the density sensor, a resistance sensor for detecting an electric resistance change of the mixed liquid, an electrostatic capacity sensor for detecting a mixed liquid permittivity change by an electrostatic capacity change, and the like can be used.

In the foregoing embodiments, since two types of inks are mixed and one of them is a colorless and transparent ink, the image can be formed by changing the density. However, in the present invention, the color and density can simultaneously be changed by mixing two or more types of inks having colors of, for example, yellow, magenta, cyan and black or mixing these inks with the colorless and transparent ink, or a monochromatic ink may be ejected. Instead of forming the image directly on the image receiving medium such as the print paper 12, the image recording head 16, 16A, 116 may temporarily form the image on an intermediate image receiving medium such as an intermediate transfer drum, so that the image can be transferred from the intermediate image receiving medium to a final image receiving medium such as print paper.

As described above, according to the present invention, while the supply amounts of the respective recording liquids are controlled in such a manner that the mixture proportion agrees with the target value of the mixture proportion obtained based on the image signal, the actual value of the mixture proportion of the plurality of recording liquids is monitored. The supply amounts of the respective recording liquids are subjected to the feedback control in such a manner that the detected actual value agrees with the obtained target value of the mixture proportion. Accordingly, the mixture proportion of the recording liquids is prevented from fluctuating by the viscosity change of the recording liquid by the temperature change, or the atmospheric pressure change, and the image quality can be enhanced.

The above has described as to the embodiments for forming an image. That is, description has been given as to two-dimensional drawing of an image on a sheet of paper or a film. However, the present invention can be used for production of a mosaic filter for use in an image display device such as a liquid crystal color display, i.e., a color filter in which color mosaics of yellow, magenta and cyan are repeatedly arranged. Further, the present invention can be also applied to manufacturing of an industrial product for forming a spatially repeated pattern.

What is claimed is:

1. An image forming apparatus for ejecting a mixed liquid constituted by a plurality of recording liquids from an ejection port while changing supply amounts of the respective recording liquids based on an image signal, and transporting the mixed liquid to an image receiving medium to form an image, said apparatus comprising:

recording liquid flow rate control means for individually controlling the supply amounts of the respective recording liquids;

actual value detecting means for detecting an actual value of a mixture proportion of the plurality of recording liquids;

a target value processor for obtaining a target value of the mixture proportion of the respective recording liquids in accordance with the image signal;

a supply amount controller for determining the supply amounts of the respective recording liquids in such a manner that the actual value of said mixture proportion agrees with said target value; and a driver for driving said recording liquid flow rate control means based on an output of said supply amount controller.

2. The image forming apparatus according to claim 1, wherein said actual value detecting means comprises:

a sensor, disposed in a mixed liquid channel through which the mixed liquid flows to the ejection port, for detecting a characteristics in either one of an optical density, an electric resistance and an electrostatic capacity of the mixed liquid; and an actual value processor for obtaining the mixture proportion of the respective recording liquids based on the detected characteristics in the mixed liquid detected by said sensor.

3. The image forming apparatus according to claim 2, wherein said sensor is disposed in the mixed liquid channel in a range of a channel length of a mixed liquid capacity for one pixel from a confluent point of the recording liquids to a downstream side.

4. The image forming apparatus according to claim 1, wherein said actual value detecting means comprises:

supply amount sensors disposed in respective recording liquid channels on an upstream side from a confluent position of the plurality of recording liquids; and an actual value processor for obtaining the mixture proportion based on outputs of the supply amount sensors.

5. The image forming apparatus according to claim 4, wherein said supply amount sensor comprises either one of a sensor for optically detecting a flow rate, a sensor for detecting an internal pressure change of the recording liquid channel, and a sensor for detecting the supply amount by a thermal flow rate measurement system.

6. The image forming apparatus according to claim 1, wherein said recording liquid flow rate control means comprises a flow control valve, disposed in a recording liquid channel, for changing a cross-sectional area of the recording liquid channel.

7. The image forming apparatus according to claim 6, wherein the flow control valve is a diaphragm valve driven by a piezoelectric device.

8. The image forming apparatus according to claim 1, wherein said recording liquid flow rate control means comprises an ink feed pump disposed in a recording liquid channel and driven by a pulse motor.

9. The image forming apparatus according to claim 1, wherein said recording liquid flow rate control means comprises:

a movable member disposed in a recording liquid channel;

an actuator for vibrating the movable member; and a check valve disposed in the recording liquid channel.

10. The image forming apparatus according to claim 1, wherein a plurality of said ejection ports are provided for respective pixels to be aligned in a direction perpendicular to a moving direction of the image receiving medium, and the respective ejection ports is independently disposed opposite to the image receiving medium.

11. The image forming apparatus according to claim 1, wherein said ejection port is disposed close to and opposite to the image receiving medium, and said mixed liquid is ejected from said ejection port and transported as a continuous fluid flow to the image receiving medium.

12. The image forming apparatus according to claim 1, wherein a plurality of said ejection ports are provided for respective pixels, the plurality of ejection ports being formed in a slot opening disposed close to and opposite to the image receiving medium, and fluid ejected from the ejection ports is combined and transported as a continuous strip-shaped fluid flow to the image receiving medium through the slot opening.

13. The image forming apparatus according to claim 11, further comprising an intermediate image receiving medium for continuously receiving the mixed liquid ejected from the ejection port and transporting the mixed liquid to the image receiving medium.

14. The image forming apparatus according to claim 1, further comprising ink transport means for leading a mixed liquid ejected from the ejection port to the image receiving medium by an ink jet mode.

15. The image forming apparatus according to claim 14, further comprising an intermediate image receiving medium for receiving the mixed liquid lead by the ink transport means to hold the mixed liquid temporarily, and for transferring the mixed liquid to a final image receiving medium.

* * * * *